US007970264B2

(12) United States Patent
Grossbach et al.

(10) Patent No.: US 7,970,264 B2
(45) **Date of Patent: *Jun. 28, 2011**

(54) WATER DISPENSER WITH SABBATH FUNCTION

(76) Inventors: Ilan Grossbach, Karkur (IL); Joseph Bach, Morgan Hill, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/685,323

(22) Filed: Jan. 11, 2010

(65) Prior Publication Data

US 2010/0108713 A1 May 6, 2010

Related U.S. Application Data

(63) Continuation of application No. 11/745,642, filed on May 8, 2007, now Pat. No. 7,672,576.

(60) Provisional application No. 60/799,044, filed on May 10, 2006.

(51) Int. Cl.
*F24H 9/20* (2006.01)
*H05B 1/02* (2006.01)

(52) U.S. Cl. ..... 392/463; 392/441; 392/454

(58) Field of Classification Search ..... 392/463
See application file for complete search history.

(56) References Cited

U.S. PATENT DOCUMENTS

| | | | | |
|---|---|---|---|---|
| 4,792,059 | A | 12/1988 | Kerner et al. | |
| 5,808,278 | A * | 9/1998 | Moon et al. | 219/506 |
| 5,975,365 | A | 11/1999 | Hsieh | |
| 6,093,312 | A | 7/2000 | Boulter | |
| 6,095,031 | A * | 8/2000 | Warne | 99/282 |
| 6,374,046 | B1 * | 4/2002 | Bradenbaugh | 392/463 |
| 7,672,576 | B2 * | 3/2010 | Grossbach et al. | 392/463 |
| 2007/0051819 | A1 * | 3/2007 | Isaacson | 236/20 R |
| 2009/0103907 | A1 * | 4/2009 | Nave | 392/463 |

FOREIGN PATENT DOCUMENTS

CA 2551750 1/2007

OTHER PUBLICATIONS

Bergen Residents Tap Latest Hot Water Innovation to Save Energy, The Bergen Insider, Jan. 2007.
ShabbHot Water Controller Provides Hot Water on Shabbos.
Hot Tap Water on Shabbat?, The Jewish Star, Nov. 24, 2006.
Sterling Product Information from Sterling website, copyrighted 2006.
Sterling Product Illustration from Sterling website, copyrighted 2006.
What Was the Problem Using Hot Water on Shabbat? from Sterling website, copyrighted 2006.
ShabbHot: Using Warm Tap Water on a Cold Winter Shabbat, The Jewish Voice and Opinion Dec. 2006.

* cited by examiner

*Primary Examiner* — Thor S Campbell
(74) *Attorney, Agent, or Firm* — Joseph Bach

(57) ABSTRACT

Water dispensers are disclosed which include a Sabbath function. When activating the Sabbath function, water refill of the hot water reservoir tank is prevented and the heating of the water in the hot reservoir tank is modified to provide a constant heating at a less than boiling temperature.

20 Claims, 5 Drawing Sheets

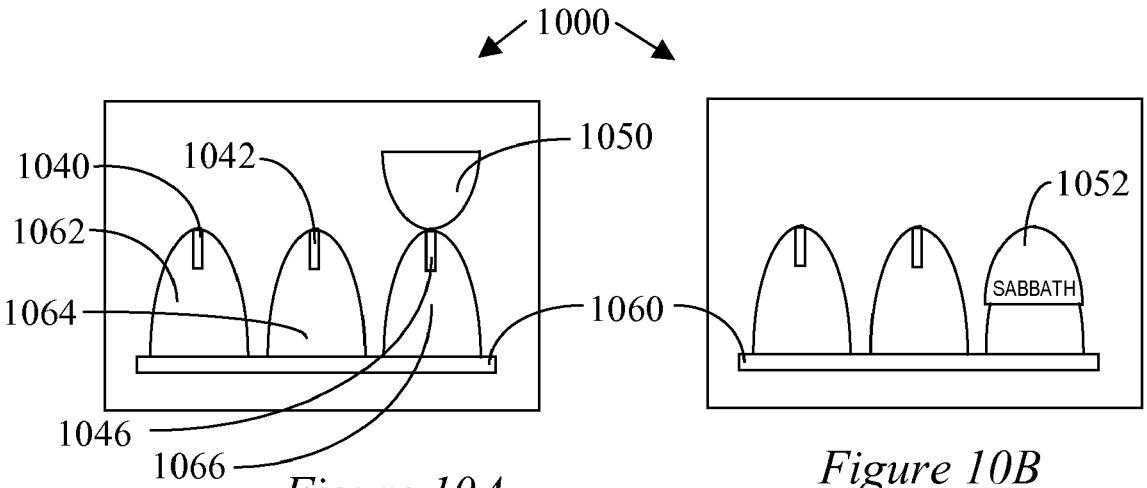
Figure 10A
Figure 10B
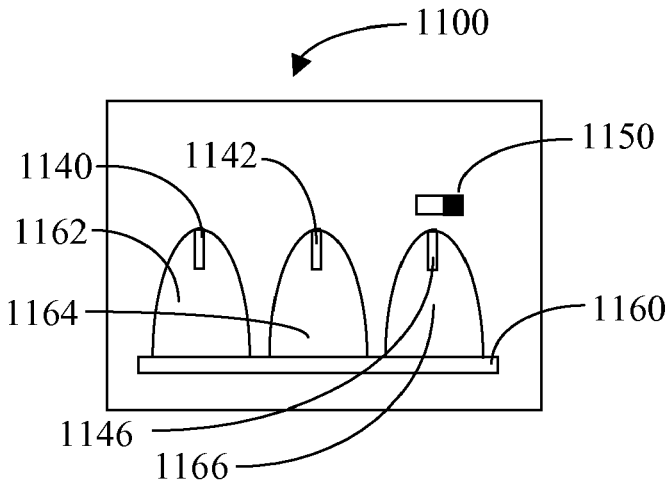
Figure 11

WATER DISPENSER WITH SABBATH FUNCTION

RELATED APPLICATIONS

This Application is a continuation of, and claims priority from, U.S. patent application Ser. No. 11/745,642, filed May 8, 2007, which claims priority from U.S. Provisional Application Ser. No. 60/799,044, filed May 10, 2006, the disclosures of which are incorporated herein in their entirety.

BACKGROUND

1. Field of the Invention

The subject invention relates to the field of water dispensers and water purifiers. The subject invention also relates to the field of home appliances operable during the Sabbath.

2. Description of Related Arts

Water dispensers are known in the art in various configurations. The simplest of configurations have an opening on the top to accommodate a bottle of water; typically a 5 gallon plastic bottle. These kinds of dispensers have a reservoir tank and a faucet to dispense the water. An upgrade version of the bottled water dispensers also has provisions for heating and/or cooling the water. In such dispensers, additional hot and cold reservoirs are provided for the hot and cold water.

Another type of water dispensers does not accept water bottles, but rather configured to be connected to city water. Such dispensers normally have various filtration systems, such as particulate filters, reverse osmosis filters, and UV light systems for filtering and treating the city water before dispensing. This kind of water dispensers also has water cooling and heating function.

A relatively new technology of water dispensers is generally referred to as atmospheric water generators (AWG). Such water dispensers do not have any water connection, but rather extract water from the humidity in the air. The AWG dispensers also have filtration and UV systems for filtering and treating the water, and also have hot and cold functions.

As is known, regardless of the type of dispenser, when a hot water function is provided, it is made by having a hot water reservoir having a heating element for heating the water. The temperature of the water in the hot water reservoir is constantly monitored and, when it drops below a preset level, the heating element is activated to reheat the water. Also, a water valve is provided which adds water to the hot water reservoir when the level drops below a prescribed level. Consequently, when a user fills up a cup with hot water, two things follow: the water valve opens to refill the hot water tank with the amount of water dispensed, the added room-temperature water lowers the temperature of the water in the reservoir, and the heater is activated to reheat the water in the hot water reservoir.

According to the practice of orthodox Jews, one may not perform an act of work on the Sabbath. For example, one may not turn on or off the lights on a Sabbath. However, if the light was turned on before the entry of the Sabbath, one may keep the light on and use it the entire Sabbath, provided one does not turn it off before the Sabbath is over. Similarly, one may use hot water if the water heater was energize prior to the entry of the Sabbath, and the water heater is not turned off or on during the Sabbath. As can be understood, due to the operation of conventional water dispensers, i.e., refill and re-heat as hot water is dispensed, Sabbath observers cannot use such dispensers during the Sabbath.

SUMMARY

The following summary of the invention is provided in order to provide a basic understanding of some aspects and features of the invention. This summary is not an extensive overview of the invention and as such it is not intended to particularly identify key or critical elements of the invention or to delineate the scope of the invention. Its sole purpose is to present some concepts of the invention in a simplified form as a prelude to the more detailed description that is presented below.

The invention was made in view of the deficiencies of the prior art and provides systems, methods and processes for overcoming these deficiencies. According to embodiments and aspects of the subject invention, water dispenser systems are provided which enable normal use during weekday, and specific use during the Sabbath.

According to various aspects of the invention, water dispensers are disclosed, which include a Sabbath function. When activating the Sabbath function, water refill of the hot water reservoir tank is prevented and the heating of the water in the hot reservoir tank is modified to provide a constant heating at a less than boiling temperature.

According to one aspect of the invention, a water dispenser includes a daily operational mode and a Sabbath operational mode. The dispenser includes a water inlet; a hot water reservoir; a water valve operable to control flow of water from said water inlet to said hot water reservoir; a water heater system; and a controller operable in a Sabbath mode to turn off said water valve to prevent water flow from said water inlet to said hot water reservoir and to operate said water heater system in a constant-on mode of operation. According to another aspect, the water heater system comprises a first heater operable in an intermittent mode and a second heater system operable in a constant-on mode. According to another aspect, the water dispenser further comprises a timer providing a signal for turning off the Sabbath mode. According to one specific aspect, the timer is programmed to count down a set time period upon activation of the Sabbath mode, and issue off signal upon termination of the time period. According to another specific aspect, the timer is programmed for date and time for entry and exit of the Sabbath for a plurality of weeks. According to yet another specific aspect, the controller further comprises a communication port for receiving transmission indicative of entry and exit of the Sabbath.

According to further aspects of the invention, the water reservoir is structured so as to prevent dispensing of water once water in the reservoir reached a level below a prescribed lower level. According to another aspect the water heater system comprises a heating element and a thermostat, and wherein during the constant-on mode of operation the thermostat is by-passed. According to another aspect, the hot water reservoir comprises a first reservoir operable during normal operational mode and a second reservoir operable during Sabbath operational mode. According to another aspect, the water dispenser comprises a water valve providing flow between the first and the second reservoirs during Sabbath mode of operation. According to another aspect the first reservoir comprises a first heater operable in an intermittent mode and the second reservoir comprises a second heater operable in a constant-on mode. According to yet another aspect, the first reservoir comprises a float valve operable to refill the first reservoir whenever water level in the first reservoir drops below a defined level, and the second reservoir comprises a water valve operable to prevent refill of water during Sabbath mode of operation. According to yet another aspect, the first heater maintains water at a first temperature and the second heater maintains the water at a second temperature lowers than the first temperature. According to one aspect the first temperature is 95° C. and the second temperature is from 75° C. to 85° C.

According to another aspect of the invention, a method for operating a water dispenser in a daily mode and a Sabbath mode is provided. The water dispenser comprising a hot water reservoir having a heater and a water valve, the method comprising: during daily mode, operating the valve to refill the reservoir whenever water level in the reservoir falls below a prescribed refill level; and, energizing the heater whenever temperature of the water drops below a prescribed reheat level; and, during Sabbath mode, operating the valve to prevent refill of the reservoir; and continuously energizing the heater. According to another aspect, the reheat level is 95° C., and the continuously energizing the heater comprises applying to the heater prescribed amount of energy to maintain the water at 75-85° C.

BRIEF DESCRIPTION OF THE DRAWINGS

Other aspects and features of the invention would be apparent from the detailed description, which is made with reference to the following drawings. It should be appreciated that the detailed description and the drawings provides various non-limiting examples of various embodiments of the invention, which is defined by the appended claims.

The accompanying drawings, which are incorporated in and constitute a part of this specification, exemplify the embodiments of the present invention and, together with the description, serve to explain and illustrate principles of the invention. The drawings are intended to illustrate major features of the exemplary embodiments in a diagrammatic manner. The drawings are not intended to depict every feature of actual embodiments nor relative dimensions of the depicted elements, and are not drawn to scale.

FIGS. 10A and 10B illustrate yet another embodiment of the invention, wherein access to intermittently-heater water is physically prevented.

FIG. 11 illustrates another embodiment of the invention, wherein dispensing from the intermittently-heater water is selectably preventable.

DETAILED DESCRIPTION

Figure 1:
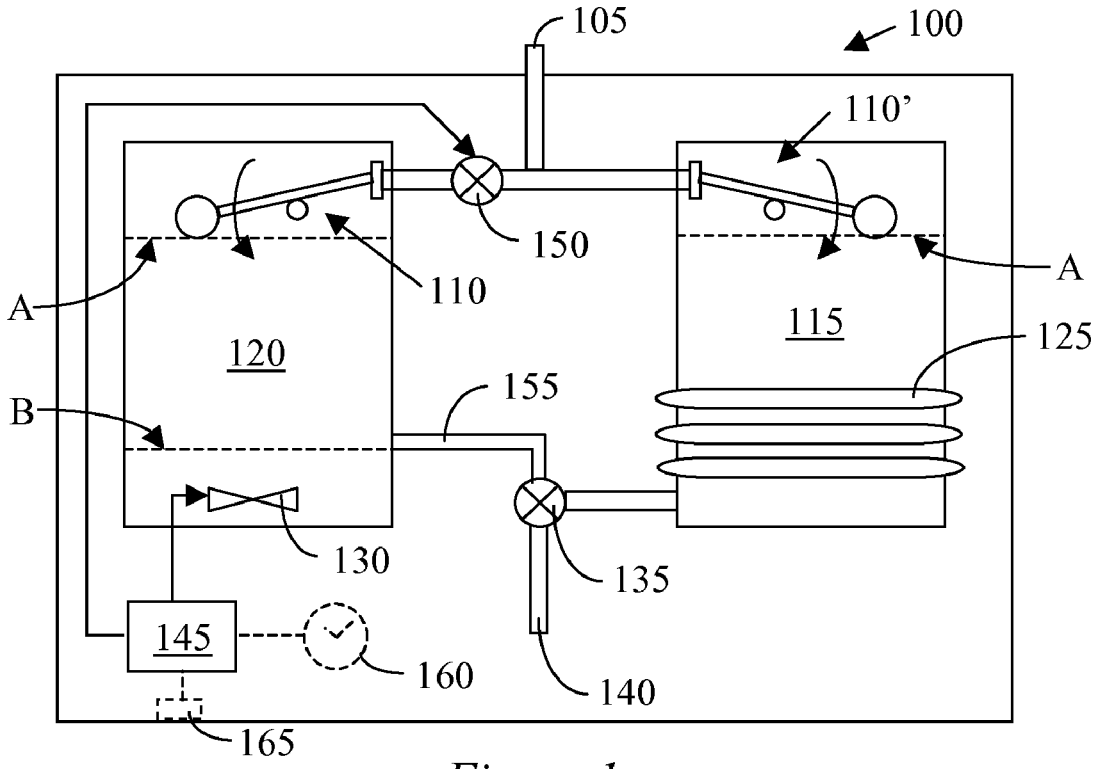
FIG. 1 is a schematic of an embodiment of the invention applied to a generic water dispenser.

FIG. 1 is a schematic of an embodiment of the invention applied to a generic water dispenser 100. Water intake 105 may be connected to city water, to an atmospheric water generator, or simply to a water bottle mounting or reservoir. That is, water intake 105 may receive water from any desired source, depending on the model and type of the dispenser 100. Water valve 110 controls the flow of water to hot water reservoir 120, and water valve 110' controls the flow of water to cold water reservoir 115. In this example, water valves 110 and 110' are shown as float-type valves; however, it should be understood that valves 110 and 110' may be implemented as any type of conventional valves or a multi-valve arrangement. The function of valves 110 and 110' is to maintain the water lever inside reservoirs 115 and 120 at pre-selected level, illustrated as level A in FIG. 1. Any conventional water valve may be used for this purpose. As an example for a conventional float valve that can be used in any of the embodiments described herein, one may use the Mini PVC Float Valve, part number 23079, available from US Plastic Corporation of Lima, Ohio. As an example for a conventional solenoid valve that can be used in any of the embodiments described herein, one may use the DEMA normally closed diaphragm operated mini-solenoid valve, part number 22197, also available from US Plastic Corporation of Lima, Ohio.

As shown, cold-water reservoir 115 is provided with chilling elements 125, which cool the water to a desired temperature. The chilling elements may be any conventional chilling elements, such as compressed gas-type chillers. Similarly, the hot water reservoir 120 is provided with a heating element 130, which heats the water to a desired temperature. Valve 135 controls water dispensing via dispensing spout 140. Valve 135 may be a single or multiple valves. Additionally, dispensing spout 140 may be a single spout, or multiple spouts, e.g., one for cold water and one for hot water. Optionally, a room temperature waterspout may be provided, which would dispense water directly from the inlet 105—bypassing reservoirs 115 and 120.

As is known in the art, heater 130 keeps the water in reservoir 120 at a pre-selected elevated temperature, normally close to boiling, e.g. 95° C. Generally, a thermocouple or other triggering device (not shown) would re-energize the heater 130 whenever the water temperature drops below the pre-selected temperature. Similarly, when hot water is dispensed from the spout 140, the inlet valve 110 would be activated to refill the reservoir 120 to level A. However, since the water from the intake 105 is at room temperature, the refill would reduce the temperature of the water in the reservoir 120, which would re-activate the heater 130 to re-heat the water to the pre-set temperature. Heater 130 may be immersed inside the reservoir or be on the exterior.

The embodiment illustrated in FIG. 1 includes a novel Sabbath function, generally and schematically indicated as 145. The Sabbath function 145 can be implemented using simplified electrical circuitry or using a more sophisticated controller, such as a microprocessor or the likes. An example of an inexpensive microcontroller that may be used is the Freescale RS08, an ultra-low-end 8-bit microcontroller, available from Freescale of Austin Tex. If more complex functionality is desired, one may use the popular S08 microcontroller, also available from Freescale. In general, when the Sabbath function is activated, such as by pressing a specifically designated button, the operation of the valve 110 and heater 130 is modified. That is, upon activating the Sabbath function, the valve 110 is deactivated, so that no refill of the reservoirs is performed. That is, even if one dispenses hot water, the valve 110 will not operate to refill the reservoir 120. This can be done by preventing the float from dropping with the water level. Alternatively, another valve 150 is provided that is turned to the off position upon activation of the Sabbath mode. For example, valve 150 may be electrically activated by receiving commands from the Sabbath function 145. As a further example, if a solenoid activated valve, such as the one noted above from the US Plastic Corporation is used, one may simply avoid applying any signal to the valve throughout the Sabbath mode of operation. Since such a valve is a normally-closed valve, so long as no signal is provided to it, no water will flow through it.

Additionally, the operation of the heater 130 is also modified. That is, rather than operating on an on/off cycle, i.e., energizing to heat the water to a near boiling temperature and then turning off until the water temperature is reduced below a set temperature and then reheating again, the heater operation is modified to that of a constant-on operation. That is, when the Sabbath function is activated, the heater is turned to a constant-on position and remains on until the Sabbath function is disabled. In this example, when the heater 130 is operating under the Sabbath mode, it heats the water to a temperature that is below its normal hot water temperature. For example, in the constant-on mode the heater may heat the water to a temperature selected from about 75-85° C. This can be done, for example, by providing a lower input wattage to the heater element 130. Alternatively, the heater element 130 may be made as a multiple-coil element, such that all of the coil elements are energized during normal operation, but only a sub-part of the coil elements is energized during constant-on mode. Either single or multiple segment heating elements suitable for operation in the embodiments illustrated herein can be obtained from Wenshou Sanchang Electrical Appliances Company of Wenzhou, China.

A safety feature is also illustrated by the embodiment of FIG. 1. Notably, the exit pipe 155 from the reservoir 120 is set so that the water level in reservoir 120 cannot be lowered below a set level, illustrated as level B. In this manner, heater 130 is always submerged in water. This ensures that during Sabbath mode of operation, when the reservoir 120 is not refilled, the heater 130 is not energized without being submerged in water; as such occurrence may damage the heater.

FIG. 1 illustrates an optional timer feature according to one embodiment of the invention. Normally, the Sabbath lasts for about 24 hours. Therefore, according to one embodiment, once the Sabbath mode is activated, timer 160 begins to run and, when it reaches a preset count, it deactivates the Sabbath mode. The preset count can be set at a safety margin to ensure that the Sabbath function is not terminated before the exit of the Sabbath, say 26 hours. According to another embodiment, the timer 160 is a programmable calendar having the entry and exit of Sabbath of every week programmed in advanced for a set period, say one year. According to this embodiment, the controller 145 automatically turns the Sabbath function on and off according to the timer 160. According to still another embodiment, the Sabbath controller 145 is connected to a communication port 165. The communication port 165 is wired or wirelessly connected to a communication system, such as phone or Internet. According to this embodiment, the Sabbath controller 145 receives "Sabbath on" and "Sabbath off" signals via the communication port. The signals can be sent from a service provider, such as via the Internet or telephone line. As one example, this can be implemented using a microprocessor, such as the microprocessor noted above available from Freescale, running a software provided by, e.g., CMX of Jacksonville, Fla., enabling communication using standards such as TCP/IP, HTTP Web Server, etc. Also, messaging systems, such as Instant Messaging and SMS format may be used to send the on and off signals, and for other communication features of this invention. When using such a configuration, another feature of this embodiment is to provide sensors to monitor the condition of various elements of the system and water filters, when such are provided. When the condition indicates that any part of the system should be serviced, a message is relayed to the service provider via the communication port. For example, sensors can be provided to monitor the current drawn by the heater elements, the gas pressure in the chilling elements, etc. If any malfunction is detected, a service center can be automatically contacted via the communication port. Fr example, an SMS message can be sent via the cellular telephony system.

The following embodiments provide some alternative implementation of the invention. Any and all of the features shown with respect to FIG. 1 may be implemented in any of the following embodiments. Conversely, various features discussed with respect to the following embodiments may be implemented in the embodiment of FIG. 1.

Figure 2:
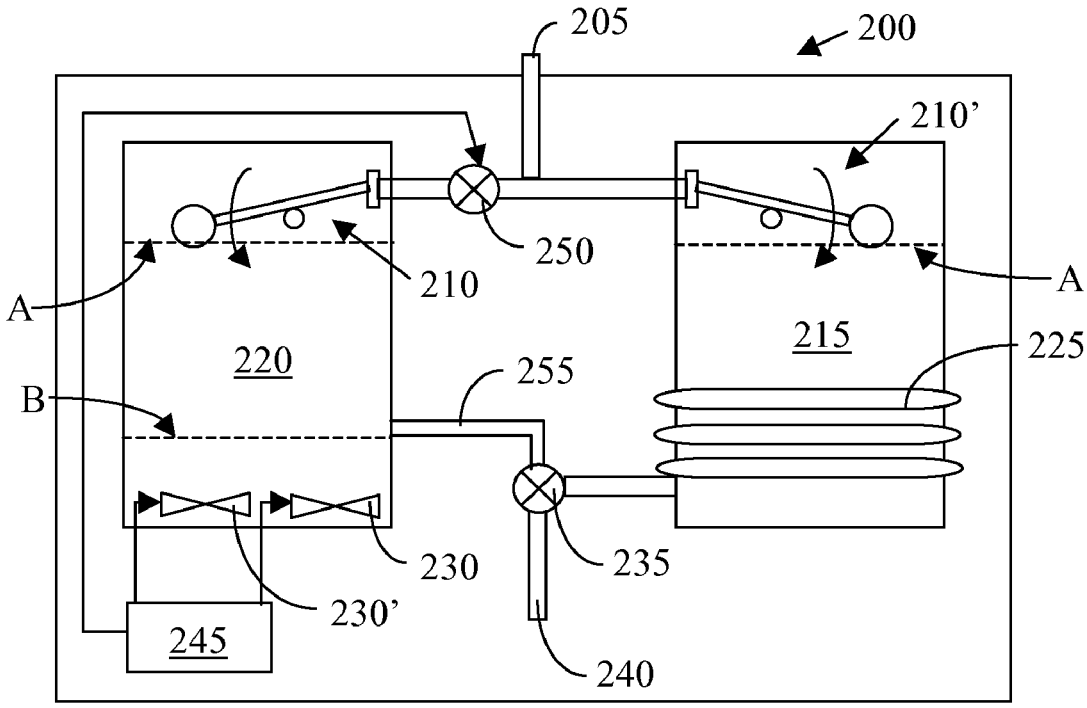
FIG. 2 is a schematic of another embodiment of the invention applied to a generic water dispenser.

FIG. 2 depicts an embodiment similar to that of FIG. 1, except that two water heaters 230, 230' are provided for reservoir 220. According to this embodiment, heater 230 is a conventional heater that operates intermittently to keep the water at temperature near boiling, e.g., 95° C. Heater 230 may also provide the conventional "re-boil" feature, which boils the water upon a command of the user. Heater 230 is activated during normal daily operation. Heater 230' is a constant on heater and is designed to keep the water at a warm temperature, normally lowered than that of heater 230. For example, heater 230' may be designed to keep the water at temperatures of 75-85° C. Heater 230' is activated during the Sabbath mode of operation, while heater 230 is deactivated during that time.

Figure 3:
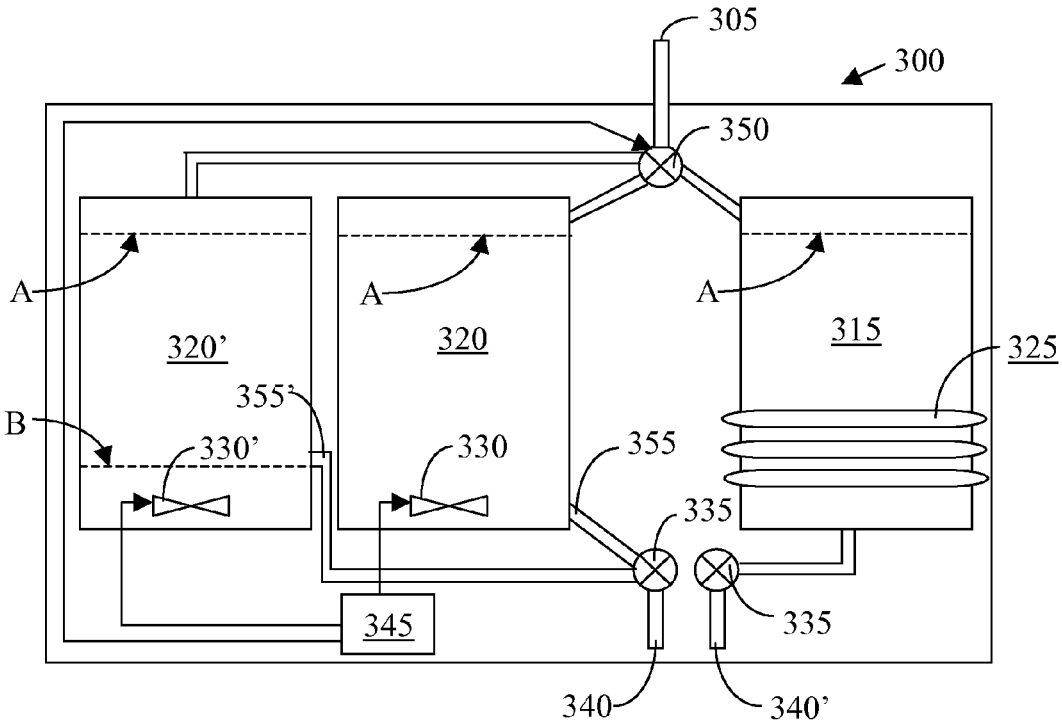
FIG. 3 depicts yet another embodiment of the invention, as applied to a generic water dispenser.

FIG. 3 depicts an embodiment wherein two hot water reservoirs are provided, reservoir 320 for daily use and reservoir 320' for Sabbath use. Reservoir 320 has a heater 330 that operates intermittently to keep the water at near boiling temperature, say 95° C. Reservoir 320' on the other hand, has heater 330' which operates on a constant-on mode to keep the water at temperature, say, 75-85° C.

FIG. 3 also depicts two alternatives that can be used in any of the other embodiments shown herein, namely, centrally controlled valve 350 and dual dispensing spouts 340 and 340' and dual dispensing valves 335 and 335'. During normal daily operation, the centrally controlled valve 350 operates to refill reservoirs 315, 320 and 320' whenever the water level in either of these reservoirs drops below a pre-set level, such as level A. Also, during normal daily operation valve 335 dispenses hot water from reservoir 320, and optionally, but not necessarily, from reservoir 320'. On the other hand, during Sabbath mode of operation, valve 350 ceases to refill reservoir 320', even if the water level drops below level A. To be sure, optionally, prior to entering into the Sabbath mode, valve 350 can be operated to ensure that the water level in reservoir 320' is indeed at level A, but thereafter the valve is operated to cease refill of water to reservoir 320'. When valve 350 is made as an electronically controlled valve, this can be implemented by first sending an on signal until the water level reaches level A, and then simply avoiding sending a "turn-on" signal to valve 350 for reservoir 320', but rather keep it in the "turn-off" position throughout the Sabbath.

Similarly, during Sabbath mode of operation valve 335 is made to dispense water only from reservoir 330'. Again, when valve 335 is made as an electronically controlled valve, controller 345 can provide the appropriate signal to valve 335 to dispense water from wither reservoir 320 or 320', depending on the mode of operation. One may also notice that in FIG. 3 the dispensing pipe 355' from reservoir 320 is at a higher level from dispensing pipe 355 of reservoir 320. This is done because reservoir 320' is not refilled during the Sabbath mode of operation. Consequently, it is desirable to ensure that the water level does not drop below a prescribed level, e.g., level B. On the other hand, reservoir 320 is refilled upon dispensing and therefore there is not need to provide such a safety feature.

Figure 4:
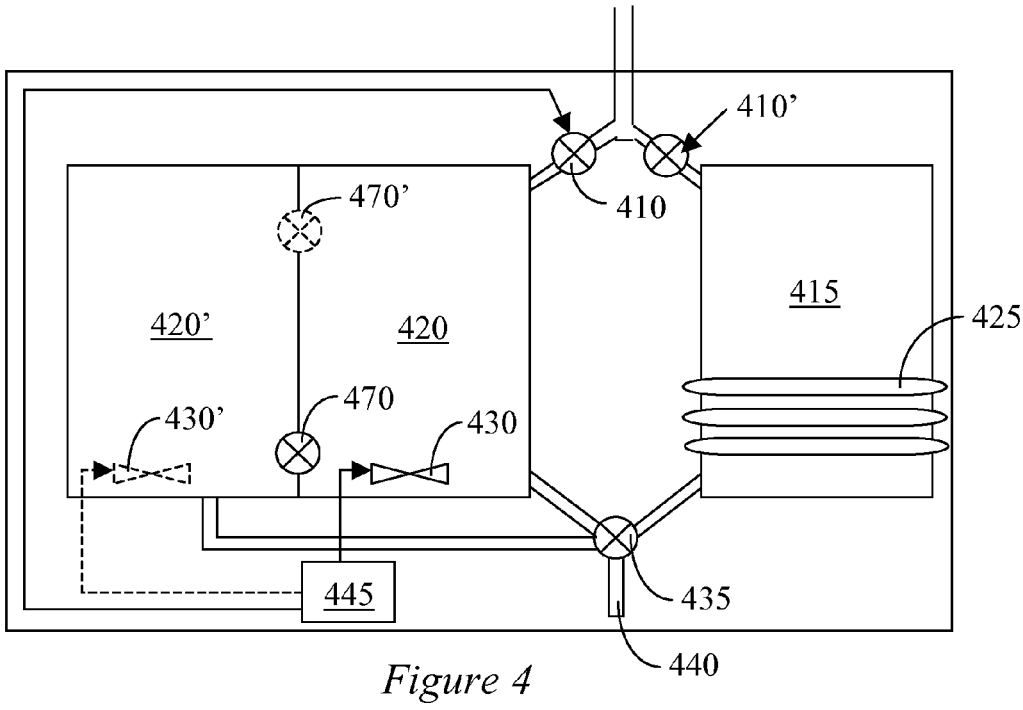
FIG. 4 depicts still another embodiment of the invention, as applied to a generic water dispenser.

FIG. 4 depicts yet another embodiment, wherein two reservoirs 420 and 420' are provided. Reservoirs 420 and 420' are connected via valve 470. Optionally, a second valve 470' may be provided to ensure adequate circulation of hot water between the two reservoirs 420 and 420'. During normal daily operation, valve 470 (and 470' if provided) is in the off position. Consequently, only the water in reservoir 420 is heated by heater 430. On the other hand, during Sabbath mode the valve 470 (and 470' if provided) is set to the open mode, so that water flows freely between reservoirs 420 and 420'. In this mode, heater 430 heats the water on both reservoirs 420 and 420'. In this mode, valve 410 is shut off so that no refill of the reservoirs 420 and 420' is possible. Similarly, heater 430 is operated in a continuous-on mode. Alternatively or in addition, a second constant-on heater 430' is provided. In one embodiment, in the Sabbath mode heater 430 is deactivated while heater 430' is activated in a constant-on mode of operation. In an alternative embodiment, during the Sabbath operation both heaters 430 and 430' are operated in a constant-on operation mode.

Figure 5:
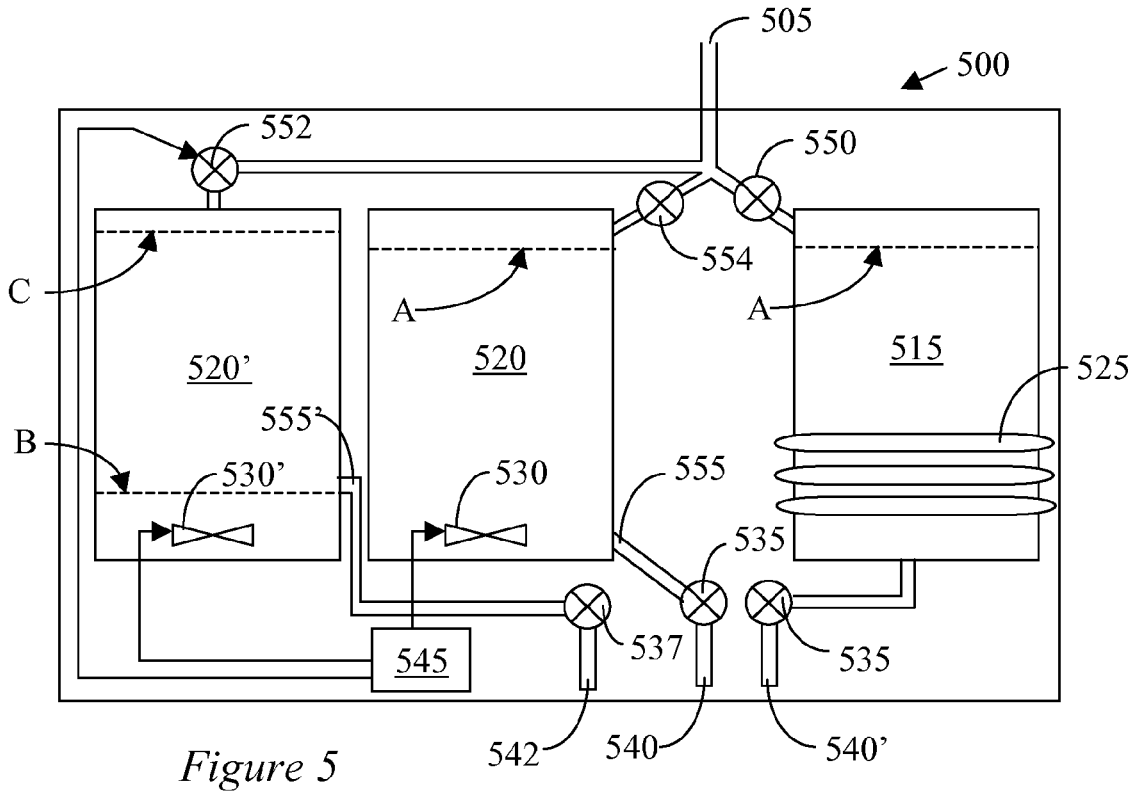
FIG. 5 depicts still another embodiment of the invention, as applied to a generic water dispenser.

FIG. 5 depicts still another embodiment of the invention, as applied to a generic water dispenser. As before, many of the features shown in the previous embodiments can be incorporated in this embodiment, while features of this embodiment may be incorporated in the other embodiments. Notably, the embodiment of FIG. 5 somewhat resembles that of FIG. 3, except that further isolation is provided between the operation of the daily hot water reservoir 520 and the Sabbath hot water reservoir 520'. Specifically, valves 550 and 554 keep refill of reservoirs 515, and 520, respectively, so that the water level does not drop below a prescribed level, e.g., level A. Valves 550 and 554 may be of a float-type valve, similar to that shown in FIGS. 1 and 2, electrically activated valves, similar to that shown in FIG. 3, etc. Valve 552 is used to fill up reservoir 520' but is not activated in a refill mode. Rather, upon activation of the Sabbath mode, the valve is operated to ensure that reservoir 520' is filled up to the full level, e.g. level C, which may or may not be the same as level A of reservoir 520.

During daily operation, hot water is dispensed via spout 540, using valve 535. On the other hand, during Sabbath mode, valve 535 is deactivated and hot water cannot be dispensed from reservoir 520. Therefore, beneficially heater 530 is also disabled and remains in the off position. During Sabbath mode, hot water is dispensed from spout 542, via valve 537. Heater 530' is operable during the Sabbath mode in a constant-on operation mode. Consequently, as can be seen, during normal daily operation hot water is dispensed from reservoir 520, while during Sabbath mode of operation hot water is dispensed from reservoir 520'. Normally, during Sabbath mode no hot water can be dispensed from reservoir 520, therefore its heater is turned off and valve 554 is inoperable for refill by reason that the water level in reservoir 520 will not drop, as no water can be dispensed therefrom.

As can be understood from the previous discussion, it is beneficial to operate heater 530 so it heats the water to a near boiling temperature, while heater 530' is operated to keep the water at a warm temperature lower than that of heater 530. Therefore, according to one embodiment, during daily operation heater 530' remains activated and valve 552 is operated to refill reservoir 520' at a prescribed water level, say C or A. Consequently, in this embodiment during normal daily operation one may dispense near boiling water from spout 540 and warm water through spout 542. Alternatively, system 500 can be made so that reservoir 520 is usable during normal daily operation only, while reservoir 520' is usable during Sabbath only.

Figure 6:
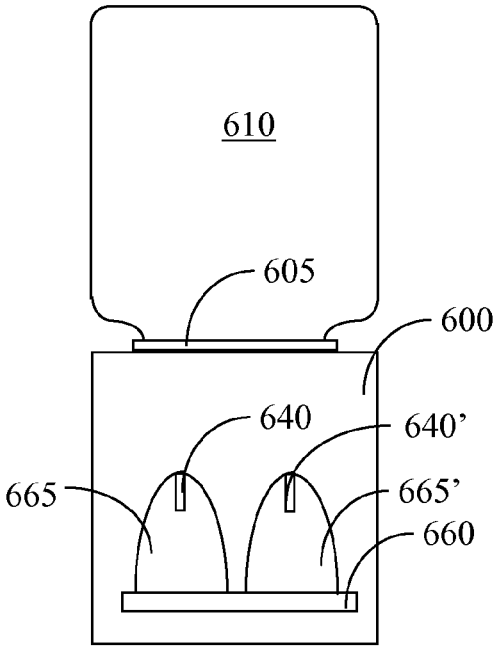
FIG. 6 illustrate an embodiment wherein water is provided from a water bottle.

FIG. 6 illustrate an embodiment wherein water is provided from a water bottle. Water dispensing system 600 has water bottle receptacle 605 on top portion thereof, to receive water bottle 610. Water bottle 610 may be any conventional bottle, such as 5 gallon water bottle available from various providers. The internal elements of water dispenser 600 may be made according to any of the embodiments described in this specification. A shelf 660 may be provided to enable placement of a cup to fill water. The water is dispensed from spouts 640 and 640', provided in cavities or indents 665 and 665'. As can be understood, depending on the embodiment used for the internal elements, one, two, or more spouts may be provided for water dispensing.

Figure 7:
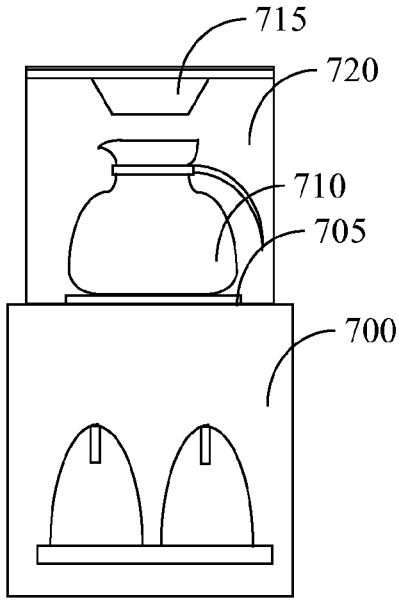
FIG. 7 illustrates an embodiment wherein the water dispenser includes a percolator.

FIG. 7 illustrates an embodiment wherein the water dispenser includes a percolator. In FIG. 7, the water dispensing system 700 is constructed using any of the embodiment disclosed in this specification. In addition, at the top portion thereof a percolator 710 is provided for preparation of hot beverages, such as coffee, tea, etc. The percolator may include a hot plate 705, which keeps the beverage in container 710 at elevated temperature. Also shown is a coffee filter 715, which is provided in a conventional manner.

Figure 8:
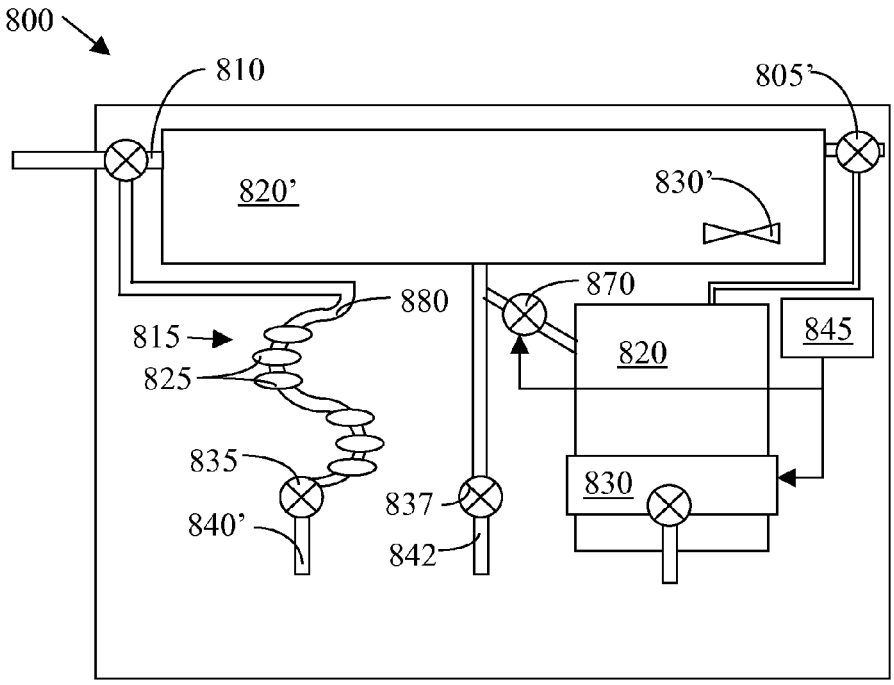
FIG. 8 illustrates another embodiment of the invention.

FIG. 8 illustrates another embodiment of the invention. The water dispenser 800 of the embodiment of FIG. 8 illustrates various features that may be interchangeable with elements of any other embodiment described in the specification. The first feature is the provision of a gravity dispensing hot water tank 820'. Hot water tank 820' is provided at the top-most part of dispenser 800. In this manner, when water is dispensed from tank 820', it is drawn by gravity—irrespective of water pressure at the inlet 810' of the tank 820'. Another feature relating to this tank 820' is the provision of pressure relief valve 805'. That is, in order to freely dispense water from tank 820' when it's inlet valve 852 is shut and provides no flow to the inlet 810', valve 805' enables inwards flow of air, e.g., from the ambient, into the tank 820'. A further feature of this embodiment is the provision of steam valve. In this embodiment, either valve 805' or a secondary valve provides an "escape" route for steam from tank 820'. The steam may be directed to the atmosphere, or to a collection tank, e.g., hot water tank 820.

Hot water tank 820' includes a constant-on heater 830', which operates to maintain the water in this tank at an elevated temperature, but below boiling. This tank may be operated as the Sabbath hot water tank. However, during Sabbath mode of operation, the inlet valve 852 is set so that no water refill is provided to tank 820'. In this embodiment water from Tank 820' is dispensed from spout 842 via valve 837. In a normal daily operation, hot water from tank 820' is also provided to hot water tank 820, via valve 870. In daily operation valve 870 operates so as to maintain water at tank 820 at a prescribed level. On the other hand, during Sabbath mode valve 870 can be shut off to prevent water dispensing to tank 820.

Tank 820 is operated to heat the water to near boiling temperature, or to re-boil the water. Any conventional water heater may be used for that purpose; however, in this particular embodiment an external "band heater" 830 is used. Band heaters are preferable to submersible heaters in that they are easier to service and have improved lifetime since no calcification buildup is possible on the heater. As is known, calcification buildup is the primary failure mode of water heater, so the use of a band heater improved the reliability of the water dispenser. The band heater may be controlled by controller 845 to re-heat or re-boil the water as required. Additionally, the controller 845 deactivates the band heater during Sabbath mode. The controller 845 may also be used to control valve 870 and deactivate it during Sabbath mode.

In the embodiment of FIG. 8 inlet valve 852 also provides water for cold water dispensing via spout 840' and valve 835. While the cold-water tank of any of the other embodiments may be used, to illustrate another feature in this embodiment and in-line chiller 815 is described. The in-line chiller may be simply formed using chiller elements 825 which are provided about water pipe 880. In this manner, as the water flow inside pipe 880, it is cooled by chiller elements 825, thereby eliminating the need for a cold water tank.

Figure 9:
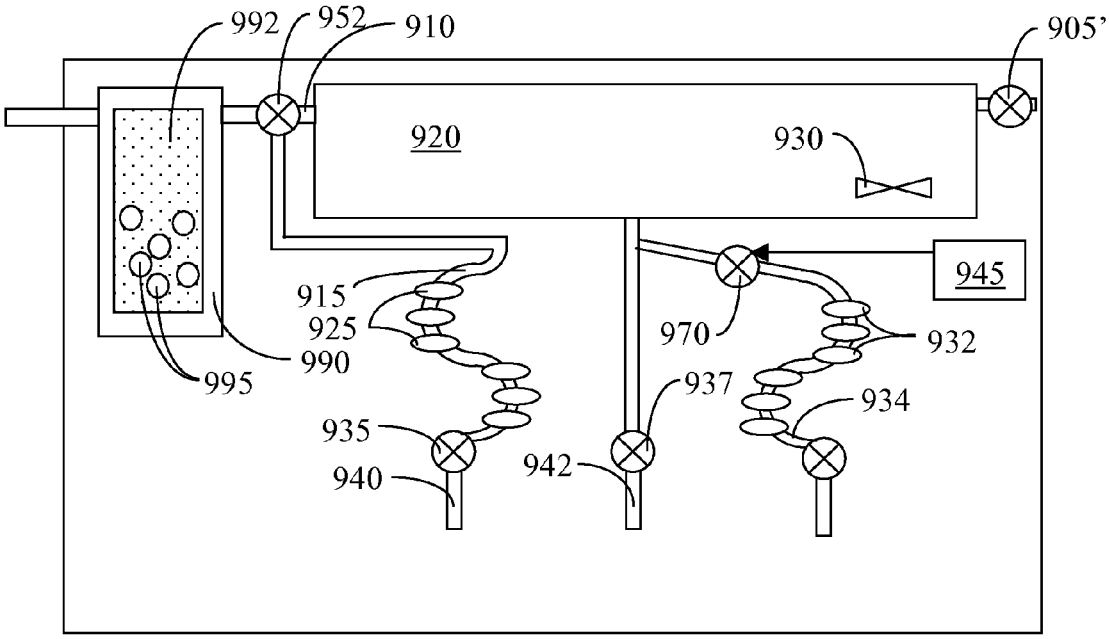
FIG. 9 illustrates yet another embodiment of the invention.

FIG. 9 illustrates yet another embodiment of the invention. The embodiment of FIG. 9 also uses the gravity tank of FIG. 8, but demonstrates further features that may be implemented in any of the other embodiments implementing the subject invention. In FIG. 9, gravity tank 920 has constant-on heater 930, inlet 910, and inlet valve 952, just as in FIG. 8. Additionally, the cold water arrangement, using pipe 915, chiller elements 925, spout 940 and valve 935, as similar to that of FIG. 8. On the other hand, rather than utilizing a re-heat water tank, in this embodiment an in-line instant water heater is provided. Heater elements 932 are provided over pipe 934, so that water flowing inside pipe 934 are instantly heater by heater elements 932. In general, controller 945 acts as a safety mechanism so that unless water is flowing in valve 970, the heater elements 932 cannot be energized. This prevents the heater elements from overheating and burning. Under such conditions, if provisions are made to prevent water from flowing into pipe 934, such as by shutting off valve 970 or utilizing other blocking mechanism (see FIG. 10B), etc., then during Sabbath mode there is no need to lock heater elements 932 from energizing, since the safety mechanism would sense no flow in valve 970 and would block energizing the heater elements 932.

As noted above, calcification is the primary cause of heater element failure. FIG. 9 illustrate a feature that helps preventing this problem. In FIG. 9, a water-conditioning element 990 is inserted before inlet 910. Element 990 may generally comprise a filter 992, such as a stainless steel filter element, or other filters. The filter element 992 removes particulates from the water. Additionally, element 990 includes water softening balls 995. Water softening elements 995 may be, e.g., Siliphos® spheres, marketed by BK Giulini GmbH, of Ludwigshafen, Germany. The composition of Siliphos spheres is $Na_{10}Ca_2P_{11}O_{35}$ and $SiO_2$. The Siliphos spheres are non-toxic, non-hazardous substance that are produced to have controlled slow dissolution in water, so as to soften the water. By inclusion of such element and the softening material therein, it is ensured that no calcification will occur in the hot water tank or path, so that the life of the heating element is prolonged.

FIGS. 10A and 10B illustrate yet another embodiment of the invention, wherein access to intermittently-heater water is selectably preventable. FIGS. 10A and 10B depict the exterior of water dispenser 1000. The water dispenser 1000 of FIGS. 10A and 10B need not have any of the features enabling Sabbath operational modes exemplified in the other embodiments, although any of them may be included. Rather, in this embodiment a selectable barrier mechanism is provided to avoid energizing any of the active elements, such as water heater or chiller, as a consequence of the direct actions of the user. As illustrated in FIGS. 10A and 10B, the water dispenser 1000 includes a shelf 1060 for placing a cup thereupon. A first water spout 1040 is provided at indent 1062 for dispensing cold water. A second spout 1042 is provided at indent 1064 for dispensing hot water from a constant-on water heater. A third spout 1046 is provided at indent 1066 for dispensing re-heated or re-boiled water. A selectable mechanism 1050, here in a form of a door, is provided so as to prevent access to spout 1046 during the Sabbath. As shown, in FIG. 10A the barrier is disengaged, in this example the door is raised, so as to expose spout 1046 and enable access to re-heated or re-boiled water. On the other hand, in FIG. 10B the barrier 1052 is engaged, in this example the door is lowered so as to partially or completely cover indent 1066, so that access to spout 1046 is physically prevented.

FIG. 11 illustrates another embodiment of the invention, wherein dispensing from the intermittently-heater water is selectably preventable. FIG. 11 depict the exterior of water dispenser 1100. The water dispenser 1100 of FIG. 11 need not have any of the features enabling Sabbath operational modes exemplified in the other embodiments, although any of them may be included. Rather, in this embodiment a selectable barrier mechanism is provided to avoid energizing any of the active elements, such as water heater or chiller, as a consequence of the direct actions of the user. As illustrated in FIG. 11, the water dispenser 1100 includes a shelf 1160 for placing a cup thereupon. A first water spout 1140 is provided at indent 1162 for dispensing cold water. A second spout 1142 is provided at indent 1164 for dispensing hot water from a constant-on water heater. A third spout 1146 is provided at indent 1166 for dispensing re-heated or re-boiled water. A selectable mechanism 1150, here in a form of a switch, is provided so as to prevent dispensing of reheated or re-boiled water from spout 1146 during the Sabbath. As shown, in FIG. 11 when the selectable mechanism is engaged, dispensing of re-heated or re-boiled water is prevented by, for example, disabling the dispensing valve.

Incidentally, the feature depicted in FIGS. 10A, 10B and 11 also forms a safety device. That is, using the physical barrier, such as the door or other mechanism, small children may be prevented from having access to the re-heated or re-boiled water.

It should be understood that processes and techniques described herein are not inherently related to any particular apparatus and may be implemented by any suitable combination of components. Further, various types of general purpose devices may be used in accordance with the teachings described herein. It may also prove advantageous to construct specialized apparatus to perform the method steps described herein. The present invention has been described in relation to particular examples, which are intended in all respects to be illustrative rather than restrictive. Those skilled in the art will appreciate that many different combinations of hardware, software, and firmware will be suitable for practicing the present invention. For example, the described methods and systems may be implemented in a wide variety of programming or scripting languages, such as Assembler, C/C++, perl, shell, PHP, Java, etc.

While the invention has been described with reference to particular embodiments thereof, it is not limited to those embodiments. Specifically, various variations and modifications may be implemented by those of ordinary skill in the art without departing from the invention's spirit and scope, as defined by the appended claims. Additionally, recitations to certain elements are meant to encompass any implementation of such elements. For example, recitation to water heater are meant to encompass any implementation of water heaters, such as immersion heater having heating element inside the reservoir, band heaters having heating elements surrounding the exterior of the reservoir, MICA heaters, etc.

The invention claimed is:

1. A water dispenser having a daily operational mode and a Sabbath operational mode, comprising:

a first heater operable in an intermittent mode;

a second water heater operable in a constant-on mode;

a controller that during daily operational mode operates the first water heater, and during Sabbath operational mode keeps the first heater off and the second water heater on.

2. The water dispenser of claim 1, further comprising a first hot water tank and a second hot water tank, and wherein the first heater is configured to heat water in the first hot water tank and the second heater is configured to heat water in the second hot water tank.

3. The water dispenser of claim 2, further comprising a cold water tank and a chiller configured to cool water in the cold water tank.

4. The water dispenser of claim 2, further comprising a water valve operable to control flow of water to the second hot water tank, and wherein the during Sabbath operational mode the water valve is turned to the off position to prevent water flow to the second hot water tank.

5. The water dispenser of claim 1, further comprising a selectable mechanism to prevent dispensing of water from the first hot water tank during the Sabbath operational mode.

6. The water dispenser of claim 4, further comprising a selectable mechanism to prevent dispensing of water from the first hot water tank during the Sabbath operational mode.

7. The water dispenser of claim 1, wherein said controller further comprises a communication port for receiving transmission indicative of at least one of entry and exit of the Sabbath.

8. The water dispenser of claim 2, wherein the second hot water tank is structured so as to prevent dispensing of water once water in said second hot water tank reached a level below a prescribed lower level.

9. The water dispenser of claim 1, wherein said second water heater provides a constant heating at less than boiling temperature.

10. The water dispenser of claim 2, further comprising a relief valve enabling inward flow of air into the second hot water tank.

11. The water dispenser of claim 1, further comprising a water bottle receptacle to receive a water bottle.

12. The water dispenser of claim 2, further comprising a steam valve providing an escape route from the first hot water tank.

13. A water dispenser comprising:

a first hot water tank having a first heater that maintain water in the first hot water tank at a first temperature near boiling;

a second hot water tank having a second heater that maintain water in the second hot water tank at a second temperature below the first temperature;

a cold water tank having a chiller to cool the water in the cold water tank.

14. The water dispenser of claim 13, wherein said first heater operates intermittently and said second heater operates in a constant-on mode of operation.

15. The water dispenser of claim 13, further comprising a first refill valve controlling refill of water to the first hot water tank and a second refill valve controlling refill of water to the second hot water tank.

16. The water dispenser of claim 15, comprising a daily operational mode and a Sabbath operational mode and wherein during daily operational mode said second refill valve refills the second hot water tank so as to maintain the water level at a prescribed level, and during Sabbath operational mode the second refill valve is shut off so as not to refill the second hot water tank.

17. The water dispenser of claim 13, further comprising a float-type valve to control refill of water into the cold water tank.

18. A method for operating a water dispenser in a daily mode and a Sabbath mode, said water dispenser having a hot water reservoir comprising a heater system and a water refill valve, the method comprising:

during daily mode, operating said heater system to turn on whenever the water temperature drops below a prescribed low level and to turn off the heater system whenever the water temperature reaches a prescribed high level; and, during Sabbath mode, operating said heater system in a constant on mode.

19. The method of claim 18, further comprising:

during daily mode, operating said valve to refill said reservoir whenever water level in said reservoir falls below a prescribed refill level to thereby maintain the water level at the prescribed level; and, during Sabbath mode, operating said valve to prevent refill of said reservoir and thereby permit the water level to drop below the prescribed level.

20. The method of claim 18, further comprising during daily mode operating said heater system to heat water in a first water tank and during Sabbath mode operating said heater system to heat water in a second water tank.

* * * * *